US006767940B2

(12) United States Patent
Voorheis et al.

(10) Patent No.: US 6,767,940 B2
(45) Date of Patent: Jul. 27, 2004

(54) GOLF BALL COMPOSITIONS COMPRISING STABLE FREE RADICALS

(75) Inventors: Peter R. Voorheis, Fall River, MA (US); David A. Bulpett, Boston, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/205,077

(22) Filed: Jul. 25, 2002

(65) Prior Publication Data

US 2004/0019138 A1 Jan. 29, 2004

(51) Int. Cl.[7] ..... A63B 37/06; C08L 9/00; C08K 5/32

(52) U.S. Cl. ..... 524/89; 524/95; 524/99; 524/104; 524/236; 525/256; 525/259; 525/274; 473/354; 473/371; 473/374; 473/377; 473/378

(58) Field of Search ..... 525/256, 259, 525/274; 524/89, 95, 99, 104, 236; 473/354, 371, 374, 377, 378

(56) References Cited

U.S. PATENT DOCUMENTS

| | | | | |
|---|---|---|---|---|
| 3,954,907 A | | 5/1976 | Schober | 260/875 |
| 4,002,594 A | | 1/1977 | Fetterman | 260/42.37 |
| 4,920,165 A | | 4/1990 | Warrach et al. | 524/91 |
| 5,608,023 A | | 3/1997 | Odell et al. | 526/225 |
| 5,627,248 A | | 5/1997 | Koster et al. | 526/217 |
| 5,696,190 A | | 12/1997 | Brooks et al. | 524/248 |
| 5,919,871 A | | 7/1999 | Nicol et al. | 525/333.8 |
| 6,018,003 A | * | 1/2000 | Sullivan et al. | 525/333.8 |
| 6,069,208 A | | 5/2000 | Novits et al. | 525/331.1 |
| 6,084,015 A | * | 7/2000 | Chino et al. | 524/189 |
| 6,162,135 A | * | 12/2000 | Bulpett et al. | 473/373 |
| 6,180,040 B1 | | 1/2001 | Ladd et al. | 264/248 |
| 6,187,847 B1 | | 2/2001 | Cogen et al. | 524/101 |
| 6,194,509 B1 | | 2/2001 | Lin et al. | 524/493 |
| 6,197,213 B1 | | 3/2001 | Novits et al. | 252/182.13 |
| 6,255,402 B1 | | 7/2001 | Boutillier et al. | 525/316 |
| 6,255,422 B1 | | 7/2001 | Bertin et al. | 526/220 |
| 6,255,448 B1 | | 7/2001 | Grimaldi et al. | 528/398 |
| 6,277,925 B1 | | 8/2001 | Biswas et al. | 525/333.7 |
| 6,339,119 B1 | | 1/2002 | Ladd et al. | 524/336 |
| 6,394,915 B1 | * | 5/2002 | Nesbitt | 473/378 |
| 6,558,275 B2 | * | 5/2003 | Ohama | 473/373 |

FOREIGN PATENT DOCUMENTS

| | | | |
|---|---|---|---|
| JP | 2000086816 | * | 3/2000 |
| WO | WO 01/30459 | * | 5/2001 |

OTHER PUBLICATIONS

U.S. patent application Ser. No. 09/894,960, Nesbitt, filed Jan. 2002.

* cited by examiner

*Primary Examiner*—David J. Buttner
(74) *Attorney, Agent, or Firm*—William B. Lacy

(57) ABSTRACT

A golf ball comprising a core, a cover, and optionally an intermediate layer between the core and the cover, wherein a stable free radical is incorporated into at least one portion of the core, the cover, and the optional intermediate layer.

32 Claims, No Drawings

GOLF BALL COMPOSITIONS COMPRISING STABLE FREE RADICALS

FIELD OF THE INVENTION

The present invention generally relates to golf balls, and, in particular, to a composition of golf ball cores and covers comprising stable free radicals.

BACKGROUND OF THE INVENTION

Solid core golf balls are well known in the art. Typically, the core is made from polybutadiene rubber material, which provides the primary source of resiliency for the golf ball. A known processing difficulty of polybutadiene cores cross-linked with peroxide initiators is the rapid increase in viscosity during cross-linking due to increase in polymer molecular weight. When the viscosity becomes too high, the partially cross-linked polymer cannot flow rapidly and does not completely fill the mold containing it. This phenomenon, known as scorch, results from premature cross-linking which may occur during compounding or manufacturing.

Scorch is accentuated by processing conditions that include high temperatures and/or high shear rates. For example, in an injection molding process, the elastomeric polymer and peroxide composition must be exposed to high shear rates and high temperatures to keep the composition fluid as it flows rapidly through the injection nozzle, runners and gates to the mold. If scorch occurs, the surface of the resulting molded golf ball core will be irregular and the composition may solidify in the runners leading to the mold, thereby unfavorably impacting the efficiency, scrap rate and safety of the process. High shear rates combined with high temperatures also occur in other common golf ball composition processing methods, such as in roll milling and extrusion.

A short scorch time (time between start of reaction and onset of crosslinking) further increases the occurrence of backrinding, the undesirable torn or gouged appearance of cross-linked articles at a mold parting line. Backrinding is caused by the continuing thermal expansion of the elastomeric polymer after cross-linking occurs, and is most severe for a spherical object, such as the outermost layers or portions of a golf ball core, where the surface area to mass ratio is at a minimum. Physical manifestations of backrinding are thought to contribute to premature failure of golf balls by making the golf ball less uniform, causing a focal stress at the gouge, and initiating cracks. Thus, it is desirable to reduce backrinding by increasing the scorch time in the cores to enhance golf ball durability.

One way to increase the scorch time is to decrease the decomposition rate of the peroxide initiator by lowering reaction temperature, resulting in a long half-life for the peroxide initiator. However, this approach is generally unsatisfactory, since a long half-life tends to result in a slow cross-linking rate and a long cure time. Recently, so-called scorch retarding or scorch resistant peroxides have become available. Exemplary applications of scorch retarding peroxides in golf balls are described in U.S. Pat. No. 6,339,119, the disclosure of which is incorporated herein by reference in its entirety. The scorch retarding peroxides slow the onset of scorch through free radical "scavengers" that react with the peroxide radicals and prevent them from immediately initiating cross-linking. However, these peroxides are only available in pre-mixed packages, which lack the flexibility of controlling the peroxide and the scavenger levels independently. Furthermore, existing systems, such as Varox® 802-40KE-HP available from R. T. Vanderbilt, do not significantly alter the cure state, unlike the compositions disclosed in the present invention.

Stable free radicals such as Tempo® have long been known to moderate the state of cure and extend the scorch time of elastomers by ways of reversibly quenching, scavenging and/or trapping early unstable free radicals formed during decomposition. Stable free radicals may further serve as a free radical capping additive or an antioxidant to prevent reaction of undesirable free radicals generated upon wear to the base rubber. It is therefore advantageous to incorporate stable free radicals in golf ball compositions, particularly in core and intermediate layers, in order to prolong scorch time for ease and flexibility of processing, as well as to impart durability and resilience to golf balls.

SUMMARY OF THE INVENTION

The present invention is directed to a golf ball having a core and a cover, particularly to a golf ball core formed from a composition including an elastomeric polymer, a free radical initiator, and at least one stable free radical. The stable free radical is present in an amount sufficient to increase the scorch time of the elastomeric polymer during curing by at least about 10%, preferably by at least about 25%, to substantially prevent backrinding. Preferably, the amount of the stable free radical is also sufficient to decrease the maximum torque of the elastomeric polymer during curing by at least about 5%, more preferably by at least about 10%. Specifically, the amount of the stable free radical is preferably between about 0.01 phr and about 20 phr by weight of the elastomeric polymer, more preferably between about 0.05 phr and about 5 phr, and most preferably between about 0.05 phr and about 1 phr.

Suitable stable free radicals for the present invention include, without limitation, nitroxide radicals; hydrazyl radicals; allyloxyl radicals; trityl radicals; and derivatives thereof having at least one substituent group comprising amino, isocyanate, hydroxyl, carboxyl, oxirane, thiirane; and mixtures thereof. Specific nitroxide radicals include, but are not limited to, 2,2,6,6-tetramethlpiperidinyloxy and derivatives thereof; 2,2,5,5-tetramethyl-1-pyrrolidinyloxy and derivatives thereof; 4,4-dimethyl-3-oxazolinyloxy and derivatives thereof; 2,6-di-t-butyl-α-(3,5-di-t-butyl-4-oxo-2,5-cyclohexadien-1-ylidene)-p-tolyloxy and derivatives thereof; di-t-butyl nitroxide and derivatives thereof; and mixtures thereof. The most preferred choice of the stable free radical for the present invention is 2,2,6,6-tetramethlpiperidinyloxy or a derivative thereof.

The elastomeric polymer for the golf ball core of the invention can be one or more natural or synthetic elastomers, including without limitation natural rubbers; balata; gutta-percha; synthetic polyisoprenes; styrene-butadiene rubbers; styrene-propylene-diene rubbers; chloroprene rubbers; acrylonitrile rubbers; acrylonitrile-butadiene rubbers; ethylene-propylene-diene terpolymers; polypropylene resins; ionomer resins; polyamides; polyesters; urethanes; polyureas; thermosetting or thermoplastic elastomers; metallocene catalyzed rubbers; styrene-ethylene block copolymers; maleic anhydride or succinate modified metallocene catalyzed ethylene copolymers; chlorinated polyethylenes; polysulfide rubbers; flurocarbons; and mixtures thereof. Preferably, the elastomeric polymer comprises at least about 40 phr by weight of a polybutadiene having a cis-1,4 content of at least about 40%, a Mooney viscosity of at least about 20, a number molecular weight of at least about 150,000, and a polydispersity of less than about 4.0.

The free radical initiator for the golf ball core may be one or more peroxides; sulfur curing agents; high-energy radiation sources capable of generating free radicals; and mixtures thereof. Suitable peroxides include, but are not limited to, dicumyl peroxide; n-butyl-4,4-di(t-butylperoxy)-valerate; 1,1-bis(t-butylperoxy)-3,3,5-trimethylcyclohexane; α,α'-bis(t-butylperoxy)-diisopropylbenzene; 2,5-dimethyl-2,5-di(t-butylperoxy) hexane; di-t-butyl peroxide; di-t-amyl peroxide; di(2-t-butyl-peroxyisopropyl)benzene peroxide; lauryl peroxide; benzoyl peroxide; t-butyl hydroperoxide; and mixtures thereof. Suitable sulfur curing agents include, without limitation, N-oxydiethylene 2-benzothiazole sulfenamide; N,N-di-orthotolyguanidine; bismuth dimethyldithiocarbamate; N-cyclohexyl-2-benzothiazole sulfenamide; N,N-diphenylguanidine; and mixtures thereof. And suitable high-energy radiation sources include electron beams; ultra-violet radiation; gamma radiation; X-ray radiation; infrared radiation; heat; and combinations thereof. The free radical initiator may further have an accelerator, such as mercaptobenzothiazole; sulfenamide; dithiocarbamate; thiuram sulfide; guanidine; thiourea; xanthate; dithiophosphate; aldehyde-amine; dibenzothiadyl disulfide; N,N'-diccyclohexyl-2-benzothia-dylsulfenamide; hexamethylenetetramine; tetramethylthiuram disulfide; tetraethylthiuram disulfide; tetrabutylthiuram disulfide; and mixtures thereof. Preferably, the free radical initiator is dicumyl peroxide having an activity between about 70% and about 100%, and is present in an amount between about 0.05 phr and about 15 phr by weight of the elastomeric polymer.

The cross-linking agent for the core composition comprises salts of unsaturated carboxylic acids having about 3 to about 8 carbon atoms; unsaturated vinyl compounds; polyfunctional monomers; phenylene bismaleimide; sulfur; and mixtures thereof. Preferably, the crosslinking agent is zinc diacrylate having an activity between about 70% and about 100%, and is present in an amount less than about 40 phr by weight of the elastomeric polymer.

The core composition of the present invention can further include one or more free radical scavangers and scorch retarders to increase the scorch time of the elastomeric polymer. Suitable free radical scavangers include benzoquinones; hydroquinones; phenols; benzaldehydes; cyclohexadiene-1-ones; and mixtures thereof. Suitable scorch retarders include cyclohexylthiophthalimide; phthalic anhydride; pyromellitic anhydride; benzene hexacarboxylic trianhydride; 4-methylphthalic anhydride; trimellitic anhydride; 4-chlorophthalic anhydride; salicylic acid; benzoic acid; maleic anhydride; citraconic anhydride; itaconic anhydride; N-nitrosodiphenyl-amine; [1,3,5-tris(4-tert-butyl-3-hydroxy-2,6-dimethylbenzyl)-1,3,5-triazine-2,4,6-(1H,3H,5H)-trione]; mono-phenyl and bis-phenyl derivatives of allyl compounds; hydroquinones with optional sulfur accelerators; acid salts of aminoalkyl phenols; triazoles; thiomorpholines; monomeric monofunctional vinyl compounds; and mixtures thereof.

Other conventional additives for the core composition of the invention include cis-to-trans catalysts; fillers; foaming agents; antioxidants; processing aids, processing oils; plasticizers; dyes and pigments; and mixtures thereof. The golf ball core may be solid or fluid-filled, be a unitary mass, or have a center and at least one outer-core layer. The above-mentioned stable free radical can be incorporated into any portion of the golf ball core, including the center, the outer core layer, or both.

The present invention is also directed to a golf ball cover formed of a composition that includes a stable free radical or a derivative thereof and at least one thermoplastic or thermosetting material. Preferably, the derivative of the stable free radical is a cationic N-oxoammonium salt formed from oxidation of a nitroxide radical that include, without limitation, 2,2,6,6-tetramethlpiperidinyloxy and derivatives thereof; 2,2,5,5-tetramethyl-1-pyrrolidinyloxy and derivatives thereof; 4,4-dimethyl-3-oxazolinyloxy and derivatives thereof; 2,6-di-t-butyl-α-(3,5-di-t-butyl-4-oxo-2,5-cyclohexadien-1-ylidene)-p-tolyloxy and derivatives thereof; di-t-butyl nitroxide and derivatives thereof; and mixtures thereof. Suitable thermoplastic or thermosetting material for the cover can be homopolymers or copolymers that include, but are not limited to, inomomeric copolymers or terpolymers of ethylene and unsaturated monocarboxylic acids; vinyl resins; polyolefins; polyurethanes; polyureas; polyamides; acrylic resins and blends thereof; block copolymers; copoly(ether-amide); polyphenylene oxide resins and blends thereof; thermoplastic polyesters; blends and alloys; and mixtures thereof.

Conventional additives that can be incorporated into the golf ball cover of the invention include, without limitation, antioxidants; catalysts; colorants including pigments and dyes; hindered amine light stabilizers; optical brighteners; UV absorbers; fillers; plasticizers; surfactants; viscosity modifiers; compatibility agents; dispersing agents; foaming agents; reinforcement agents; release agents; and mixtures thereof. The cover may be a single layer or multiple layers having at least one inner cover layer and an outer cover layer.

The present invention is further directed to a golf ball having a core, a cover, and at least one intermediate layer disposed between the core and the cover, wherein at least one stable free radical is present in the core, the intermediate layer, or both. Suitable materials for the intermediate layer include natural rubbers; balata; gutta-percha; cis-polybutadienes; trans-polybutadienes; synthetic polyisoprenes; polyoctenamers; styrene-propylene-diene rubbers; metallocene rubbers; styrene-butadiene rubbers; ethylene-propylenes; chloroprene rubbers; acrylonitrile rubbers; acrylonitrile-butadiene rubbers; styrene-ethylene block copolymers; maleic anhydride or succinate modified metallocene catalyzed ethylene copolymers; polypropylene resins; ionomer resins; polyamides; polyesters; urethanes; polyureas; chlorinated polyethylenes; polysulfide rubbers; flurocarbons; or a mixture thereof.

In the presence of the stable free radical, the core and the intermediate layer can be co-cured simultaneously. The core may further have a center and at least one outer core layer. Preferably, the intermediate layer has a thickness of about 0.01 inches to about 0.40 inches, and the cover has a thickness between about 0.01 inches and about 0.10 inches.

DEFINITIONS

As used herein, the term "minimum torque" ($M_L$) is the torque of an elastomer measured prior to undergoing a crosslink reaction using a rheometer.

As used herein, the term "maximum torque" (S'max or $M_H$) is the torque of an elastomer measured at any point of time during a crosslink reaction or at the completion of a crosslink reaction using a rheometer.

As used herein, the term "delta torque," also known as extent of crosslinking, is the difference between the maximum torque $M_H$ and the minimum torque $M_L$.

As used herein, the term "scorch time" (TS2), also known as scorch safety, is the time to 2% of delta torque above the minimum torque.

As used herein, the term "optimum cure time" (TC90), also known as optimum crosslink time, is the time to 90% of the delta torque above the minimum torque.

As used herein, the term "(meth)acrylic" includes both methacrylic and acrylic.

As used herein, the term "filler" includes any compound or composition that can be used to vary density, specific gravity, tear strength, rheological and mixing properties, and other properties of the subject golf ball compositions.

The term "about," as used herein in connection with one or more numbers or numerical ranges, should be understood to refer to all such numbers, including all numbers in a range.

DETAILED DESCRIPTION OF THE INVENTION

The present invention is directed to golf ball compositions for forming golf balls comprising a cover and a core and, optionally, an intermediate layer situated between the cover and the core. The golf ball cores of the present invention may comprise a variety of constructions. For example, the core may comprise a single layer or a plurality of layers. The core may also comprise a layer formed of a tensioned elastomeric material that is also suitable as an intermediate layer. The innermost portion of the core may be solid or it may be a liquid filled sphere. As with the core, the intermediate layer may also comprise a plurality of layers, and the cover may comprise at least one inner cover layer and an outer cover layer. While the compositions of the present invention may be present in any of the layers described above, they are preferably present in either a core or an intermediate layer. More preferably, the compositions of the invention are present in the core.

The materials for solid core compositions in accordance with the present invention include an elastomeric polymer ("base rubber"), a free radical initiator ("FRI"), a crosslinking agent, and a stable free radical ("SFR") capable of extending the onset of scorch by significantly increasing the scorch time. Optionally, the core compositions may further comprise cis-to-trans catalysts, fillers, antioxidants, and other additives known to one of ordinary skill in the art. The FRI, the crosslinking agent and the SFR may be pre-mixed and the pre-mixture added to the compositions, or they may be added, together or separately, to the compositions.

The SFR must not be confused with free radicals having a transitory lifetime (a few milliseconds), such as the free radicals generated by the FRI including peroxides, hydroperoxides, sulfur-based compounds, and azo initiators. The FRI radicals tend to accelerate curing of the polymer, while the SFRs generally tend to moderate the state of cure and extend the scorch time by ways of reversibly quenching, scavenging and/or trapping early unstable free radicals formed during FRI decomposition. Specific cure characteristics that may be altered by the incorporation of the SFR's in the present invention include maximum torque, delta torque, scorch time, and optimum cure time.

The cure-moderation effect of the SFR's concomitantly reduces the material hardness of the elastomeric polymer. In general, the higher the content (weight percentage) of the SFR in the composition, the softer the resulting polymer becomes. Variations in the content of the stable free radicals may therefore be explored in golf balls where it is preferred that different layers have different flexural moduli or hardness, or where a particular cure gradient, modulus gradient or hardness gradient is desired. Any combinations of these layers may be co-cured to result in a unique combination of moduli or hardness that would not be otherwise achievable.

The SFR may further serve as a free radical capping additive or an antioxidant to the core composition to prevent reaction of undesirable free radicals generated upon wear to the base rubber, as described in U.S. Pat. No. 6,194,509, the disclosure of which is incorporated herein by reference in its entirety. In this capacity, the SFR improves filler dispersion, improves base rubber content, reduces hysteresis, improves processability, and improves resilience of the resulting core and/or layer.

The SFR may be any compound containing a radical that can be isolated in the radical state at ambient temperature and stable in the presence of oxygen. The SFR is sufficiently stable for its free radical state to be characterized by spectroscopic methods. Suitable SFRs for the compositions of the present invention include, without limitation, nitroxide radicals, hydrazyl radicals, allyloxyl radicals, trityl radicals, and derivatives thereof having at least one substituent group comprising amino, isocyanate, hydroxyl, carboxyl, oxirane and thiirane. General formulas and illustrative compounds for the SFRs are described in U.S. Pat. Nos. 5,322,912, 6,084,015, 6,156,858, 6,194,509, 6,255,448, 6,271,340, 6,281,311, 6,288,186 and 6,353,065, the disclosures of which are incorporated herein by reference in their entirety. Exemplary SFRs include 2,2,6,6-tetramethylpiperidinyloxy (Tempo®) and derivatives thereof; 2,2,5,5-tetramethyl-1-pyrrolidinyloxy (Proxyl®) and derivatives thereof; 4,4-dimethyl-3-oxazolinyloxy (Doxyl®) and derivatives thereof; 2,6-di-t-butyl-α-(3,5-di-t-butyl-4-oxo-2,5-cyclohexadien-1-ylidene)-p-tolyloxy (Galvinoxyl®) and derivatives thereof; di-t-butyl nitroxide and derivatives thereof; and mixtures thereof, all of which are available from Sigma-Aldrich. Preferably the SFR is 2,2,6,6-tetramethylpiperidinyloxy or a derivative thereof.

The amount of the SFR present in the compositions of the present invention preferably is sufficient to delay the onset of crosslinking (i.e., retard scorch) in the elastomeric polymer and substantially prevent backrinding. More preferably, the amount of the SFR is sufficient to extend the scorch time by at least about 10%, most preferably by about 25%. Alternatively or concomitantly, the stable free radical is preferred to reduce the maximum torque by at least about 5%, more preferred by at least about 10%. Specifically, the amount of SFR preferably ranges from about 0.01 to about 20 parts per hundred parts ("phr") by weight of the base rubber. More preferably, the range for the SFR is between about 0.05 phr and about 5 phr of the base rubber, and most preferably, between about 0.05 phr to about 1 phr.

The base rubber typically includes natural or synthetic elastomers such as natural rubbers; balata; gutta-percha; synthetic polyisoprenes; styrene-butadiene rubbers; styrene-propylene-diene rubbers; chloroprene rubbers; acrylonitrile rubbers; acrylonitrile-butadiene rubbers; ethylene-propylene-diene terpolymers ("EPDM"); polypropylene resins; ionomer resins; polyamides; polyesters; urethanes; polyureas; thermosetting or thermoplastic elastomers such as Pebax® (Elf-Atochem), Hytrel® (DuPont) and Kraton® (Shell Chemical); and mixtures thereof. Metallocene rubbers are also preferred for the elastomeric compositions, including without limitation polybutadiene; ethylene-propylenes; EPDM; styrene-butadiene rubbers; styrene-propylene-diene rubbers; and mixtures thereof. These metallocene rubbers are typically synthesized via the co-polymerization of functionalized monomers using metallocene catalysts or other single-site catalysts. The elastomeric composition may also comprise styrene-ethylene block copolymers; maleic anhydride or succinate modified metallocene catalyzed ethylene copolymers; chlorinated polyethylenes; polysulfide rubbers; flurocarbons; and mixtures thereof.

Preferably, the base rubber comprises at least about 40 phr by weight of polybutadiene. The polybutadiene preferably has a cis-1,4 content of at least about 40%, more preferably at least about 90% and most preferably at least about 95%. Specifically, the polybutadiene has a high-Mooney viscosity. Preferably, the polybutadiene has a Mooney viscosity of at least about 20, more preferably at least about 30. Also preferably, the polybutadiene has a molecular weight of at least about 150,000 and a polydispersity of less than about 4.0. The base rubber may comprise a blend of two or more polybutadiene rubbers having different weight percentages, catalysts, molecular weights, Mooney viscosity, polydispersity, filler contents, crosslinking agent contents, or cis- and trans-isomer contents.

The FRI is used to promote the crosslink reaction between the crosslinking agent and the base rubber. Suitable FRI is typically a peroxide, preferably an organic peroxide, and includes without limitation dicumyl peroxide; n-butyl-4,4-di(t-butylperoxy)-valerate; 1,1-bis(t-butylperoxy)-3,3,5-trimethylcyclohexane; α,α'-bis(t-butylperoxy)-diisopropylbenzene; 2,5-dimethyl-2,5-di(t-butylperoxy) hexane; di-t-butyl peroxide; di-t-amyl peroxide; di(2-t-butyl-peroxyisopropyl)benzene peroxide; lauryl peroxide; benzoyl peroxide; t-butyl hydroperoxide; and mixtures thereof. Preferably, the peroxide FRI is dicumyl peroxide. Other peroxides and mixtures of peroxides having different activation temperatures may be employed here as described in U.S. Pat. No. 6,180,040, the disclosure of which is incorporated herein by reference in its entirety. Other useful FRIs would be readily apparent to one of ordinary skill in the art. The FRI, at between about 70% and about 100% activity, is preferably added in an amount ranging between about 0.05 phr and about 15 phr by weight of the base rubber. More preferably, the amount of FRI added ranges between about 0.1 phr and about 5 phr, and most preferably between about 0.25 and about 1.5 phr. The FRI may alternatively or additionally be one or more of electron beams; gamma radiation; infrared radiation; ultra-violet radiation; X-ray radiation; or any other high-energy radiation source capable of generating free radicals. It should be further understood that heat often facilitates initiation of the generation of free radicals.

In accordance to the present invention, the FRI may be a scorch retarding peroxide composition comprising at least one of the peroxides mentioned above and at least one free radical scavenger serving as a scorch retarder in conjunction with the SFR. Free radical scavengers are well known to those of ordinary skill in the art, and suitable candidates for the invention may include, but are not limited to, benzoquinones, such as 2,3,5,6-tetramethylbenzoquinone, hydroquinones, such as 2-t-butylhydroquinone, phenols, such as 2,2'-methylene-bis(4-methyl-6-t-butylphenol), benzaldehydes, such as 2,6-di-t-butyl-4-hydroxybenzaldehyde, and cyclohexadiene-1-ones, such as 2,6-di-t-butyl-4-methylene-2,5-cyclohexane-1-one. Preferred free radical scavengers include 2,3,5,6-tetramethylbenzoquinone, 2-t-butylhydroquinone, 2,2'-methylene-bis(4-methyl-6-t-butylphenol), and mixtures thereof. Commercial scorch retarding peroxides which are useful for forming the compositions of the invention include but are not limited to Varox® DCP-R, DCP-40KE-HP, 802-40KE-HP, and DBPH-50-HP, all from R. T. Vanderbilt, Peroximon® DC-400OKEP-SR®, Luperco® 230XL-SR, 231 KE-SR, and 101-XL-SR, and Retilox® F40KEP-SR, all from Elf Atochem N.A., and their commercial equivalents available from other suppliers.

Other scorch retarders that are suitable to be used in combination with the SFRs of the invention include cyclohexylthiophthalimide; phthalic anhydride; pyromellitic anhydride; benzene hexacarboxylic trianhydride; 4-methylphthalic anhydride; trimellitic anhydride; 4-chlorophthalic anhydride; salicylic acid; benzoic acid; maleic anhydride; citraconic anhydride; itaconic anhydride; N-nitrosodiphenyl-amine; mono-phenyl and bis-phenyl derivatives of allyl compounds as described in U.S. Pat. No. 6,277,925; hydroquinones with optional sulfur accelerators as described in U.S. Pat. Nos. 6,197,213 and 6,069,208; acid salts of aminoalkyl phenols as described in U.S. Pat. No. 5,696,190; triazoles as described in U.S. Pat. No. 4,920,165; thiomorpholines as described in U.S. Pat. No. 4,002,594; monomeric monofunctional vinyl compounds described in U.S. Pat. No. 3,954,907; and [1,3,5-tris(4-tert-butyl-3-hydroxy-2,6-dimethylbenzyl)-1,3,5-triazine-2,4,6-(1H,3H,5H)-trione] as illustrated in U.S. Pat. No. 6,187,847, the disclosures of which are incorporated herein by reference in their entirety. Similar to the free radical scavangers described above, these scorch retarders may be pre-mixed with the FRI's and the SFR's, and the mixture added to the core compositions. Alternatively, these components may be added independently, together or separately, to the core compositions.

Alternatively, sulfur-based curing agents with optional accelerators may be use in combination with or in replacement of the peroxide FRIs to crosslink the base rubber, as described in U.S. patent application Ser. No. 09/894,960, the disclosure of which is incorporated herein by reference in its entirety. Specific sulfur curing agents include, without limitation, N-oxydiethylene 2-benzothiazole sulfenamide; N,N-di-orthotolyguanidine; bismuth dimethyldithiocarbamate; N-cyclohexyl-2-benzothiazole sulfenamide; N,N-diphenylguanidine; and mixtures thereof. The accelerators may be mercaptobenzothiazoles; sulfenamides; dithiocarbamates; thiuram sulfides; guanidines; thioureas; xanthates; dithiophosphates; aldehyde-amines; dibenzothiadyl disulfide; N,N'-diccyclohexyl-2-benzothia-dylsulfenamide; hexamethylenetetramine; tetramethylthiuram disulfide; tetraethylthiuram disulfide; tetrabutylthiuram disulfide; and mixtures thereof.

The cross-linking agent suitable for use in the scorch retarding compositions of the invention may be formed from unsaturated carboxylic acids. Preferably, such agents are formed from the salts of α,β-ethylenically unsaturated carboxylic acids having about 3 to about 8 carbon atoms, such as methacrylic, acrylic, cinnamic and crotonic acids. Suitable counterions include but are not limited to quaternary phosphonium or ammonium cations, such as tetraalkyl phosphonium, and metal cations, such as sodium, lithium, potassium, magnesium, calcium, zinc, barium, aluminum, tin, zirconium, nickel and cadmium. Zinc, sodium and magnesium are preferred as metal cations.

Other cross-linking agents may comprise unsaturated vinyl compounds. For example, cross-linking agents with vinyl unsaturation that may be used in the scorch retarding compositions of the invention include but are not limited to N,N'-m-phenylene dimaleimide (available as Vanax® MBM from R. T. Vanderbilt), trimethylolpropane trimethacrylate (Sartomer® SR-350 from Sartomer), triallyl trimellitate (Triam® 705 from Wako Chemicals), triallylisocyanurate (Taic® from Nippon Kasei Chemical), and acrylate terminated liquid polybutadiene (PolyBD® 300 from Elf Atochem N.A.).

More preferably, the cross-linking agent is a mono-(meth) acrylic acid or di-(meth)acrylic acid metal salt, wherein the cation is zinc, sodium, magnesium, or mixtures thereof. Even more preferably, the cross-linking agent is zinc diacrylate ("ZDA"), zinc dimethacrylate ("ZDMA"), or mixtures thereof. Of the common acrylate cross-linkers, ZDA has generally been found to produce golf balls with greater initial velocity than ZDMA, therefore, the former is most preferred. The ZDA can be of various grades of purity. For the purposes of this invention, the lower the quantity of zinc stearate present in the ZDA the higher the ZDA purity. ZDA containing less than about 10% zinc stearate is preferable. More preferable is ZDA containing between about 4% and about 8% zinc stearate. Suitable, commercial sources for ZDA include Rockland React-Rite and Sartomer. The crosslinking agent may be present in an amount from about 0 to about 40 phr of the base rubber. Base rubbers having little or no ZDA have low water vapor transmission rates. They are less prone to moisture absorption and related deterioration in playability and performance because of the low permeability.

The polybutadiene rubber may be mixed with a cis-to-trans catalyst and an optional accelerator during molding to increase resilience and/or decrease compression of the golf ball cores formed therefrom. A "cis-to-trans catalyst" herein means any compound or a combination thereof that will convert at least a portion of cis-polybutadiene isomer to trans-polybutadiene isomer at a given temperature. Suitable cis-to-trans catalysts includes substituted or unsubstituted aromatic organic compounds that are substantially free of sulfur; organosulfurs; halogenated organosulfurs; metal-containing organosulfurs; inorganic sulfides; aromatic organometallics; elemental sulfur; polymeric sulfur; and mixtures thereof, as described in U.S. Pat. Nos. 6,162,135 and 6,291,592, and in U.S. patent application Ser. Nos. 09/461,421 and 09/461,736, the disclosures of which are incorporated herein by reference in their entirety.

The compositions of the present invention may also include fillers to adjust the density and/or specific gravity of the core. The fillers are generally inorganic, and suitable fillers include numerous metals or metal oxides and salts, such as tungsten, tungsten carbide, zinc oxide, tin oxide, calcium oxide, barium sulfate, zinc sulfate, calcium carbonate, barium carbonate, zinc carbonate, as well as clay, an array of silicas, regrind (recycled core material typically ground to about 30 mesh particle), high-Mooney-viscosity rubber regrind, and mixtures thereof. Fillers may also include various polymers, ceramics, and glass microspheres that are solid or hollow, and filled or unfilled, all of which are readily selected by one of ordinary skill in the art.

Alternatively, fillers having a specific gravity less than that of the base polybutadiene rubber (typically about 0.91) may be used to reduce the specific gravity of the core, if so desired. Such density reducing fillers include foaming agents, blowing agents, micro balloons, cellular foams and other materials having a relatively large void volume. Typically, such fillers have a specific gravity less than 1.0. Golf ball compositions made according to the present invention can be of any specific gravity applicable in a golf ball. The preferred range of specific gravity for golf balls of the present invention is from about 0.9 to about 1.5, more preferably from about 1 to about 1.3. The specific gravity of the golf ball depends upon the size of the finished ball and the size and specific gravity of the core and, when present, of intermediate layer(s) and the cover.

The amount and type of the filler utilized is governed by the amount and weight of other ingredients in the composition, since a maximum golf ball weight of 1.620 ounces has been established by the United States Golf Association. Appropriate fillers generally used range in specific gravity from about 2.0 to about 5.6. The filler is generally added in an amount ranging from about 5 phr to about 70 phr by weight based upon 100 parts of the elastomeric polymer. Preferably, the amount of the filler added ranges from about 10 phr to about 50 phr.

Antioxidants may also be included in the scorch retarding compositions produced according to the present invention. Antioxidants are compounds that prevent the breakdown of the base rubber. Antioxidants useful in the present invention include, but are not limited to, quinoline type antioxidants, amine type antioxidants and phenolic type antioxidants. Other ingredients, such as processing aids, processing oils, plasticizers, dyes and pigments, as well as other additives well known to the skilled artisan may also be used in the present invention in amounts sufficient to achieve the purpose for which they are typically used.

The stable free radicals may likewise be used in any intermediate layers disposed between a core and a cover in a golf ball. Materials suitable for forming the intermediate layers include natural rubbers; balata; gutta-percha; cis-polybutadienes; trans-polybutadienes; synthetic polyisoprenes; polyoctenamers; styrene-propylene-diene rubbers; metallocene rubbers; styrene-butadiene rubbers; ethylene-propylenes; chloroprene rubbers; acrylonitrile rubbers; acrylonitrile-butadiene rubbers; styrene-ethylene block copolymers; maleic anhydride or succinate modified metallocene catalyzed ethylene copolymers; polypropylene resins; ionomer resins; polyamides; polyesters; urethanes; polyureas; chlorinated polyethylenes; polysulfide rubbers; flurocarbons; or a mixture thereof.

The materials used in forming either the golf ball center or any portion of the core, in accordance with the invention, may be combined to form a mixture by any type of mixing known to one of ordinary skill in the art. Suitable types of mixing include single pass and multi-pass mixing. Suitable mixing equipment is well known to those of ordinary skill in the art, and such equipment may include a Banbury mixer, a two-roll mill, or a twin screw extruder. Conventional mixing speeds for combining polymers are typically used. The mixing temperature depends upon the type of polymer components, and more importantly, on the type of free-radical initiator. Suitable mixing speeds and temperatures are well known to those of ordinary skill in the art, or may be readily determined without undue experimentation.

The mixture can be subjected to compression molding, injection molding, transfer molding, or a combination thereof to obtain solid spheres for the center or hemispherical shells for forming an intermediate layer. The temperature and duration of the molding cycle are selected based upon reactivity of the mixture. The molding cycle may have a single step of molding the mixture at a single temperature for a fixed duration of time. The molding cycle may also include a two-step process, in which the polymer mixture is held in the mold at an initial temperature for an initial duration of time, followed by holding at a second, typically higher temperature for a second duration of time. Preferably a single-step cure cycle is employed. Although the curing time depends on the various materials selected, those of ordinary skill in the art will be readily able to adjust the curing time upward or downward based on the particular materials used and the discussion herein.

When a golf ball of the present invention includes an inner cover layer and an outer cover layer, these layers may comprise thermoplastic and/or thermosetting materials such as ionic copolymers or terpolymers of ethylene and an unsaturated monocarboxylic acid, including Surlyn® and Iotek®. The carboxylic acid groups in these ionomers include methacrylic, crotonic, maleic, fumaric or itaconic acid totally or partially neutralized with metal salts. Alternatively, the metal salts of the ionomers may be used in combination with, or be replaced by, cationic derivatives of the SFR's mentioned above. Preferably, the cationic derivatives are cationic N-oxoammonium salts formed from the nitroxide radicals through oxidation.

A golf ball of the invention can likewise include one or more homopolymeric or copolymeric inner and/or outer cover materials, including vinyl resins comprising vinyl chloride; polyolefins such as polyethylene and ethylene methylacrylate copolymer; polyurethanes comprising polyols and polyisocyanates; polyureas; polyamides such as poly(hexamethylene adipamide) and poly(caprolactam); acrylic resins and blends thereof; block copolymers such as styrene-butadiene rubber and isoprene- or ethylene-butylene rubber; copoly(ether-amide) such as Pebax®; polyphenylene oxide resins and blends thereof such as Noryl®; thermoplastic polyesters such as Hytrel® and Lomod®; blends and alloys including polycarbonate with acrylonitrile butadiene styrene and polyvinyl chloride with acrylonitrile butadiene styrene; blends of thermoplastic rubbers with polyethylene and propylene; and mixtures thereof.

Generally the polymerization of these materials involve the application of a peroxide-based curing system. In a similar capacity as described above, the SFR's may be used in the cover layer compositions to moderate the cure and enhance the processability of the polymers such as polyurethanes. The SFR's may also function as antioxidants to end-cap undesirable radicals generated by UV exposure, normal wear and aging, thereby enhancing durability and extending shelf life of the golf balls. Furthermore, in the case of the nitroxide SFR's, they may impart special and desirable characteristics to the polyurethane cover compositions by functioning as unique tertiary amines, a group of polyurethane catalysts known to one of ordinary skill in the art.

Conventional additives suitable for the cover layer compositions of the present invention include, but are not limited to, antioxidants; catalysts; colorants including pigments and dyes; hindered amine light stabilizers; optical brighteners; UV absorbers; metals; plasticizers; surfactants; viscosity modifiers; compatibility agents; dispersing agents; foaming agents; reinforcement agents; release agents; and mixtures thereof. Such additives may be incorporated in any amounts that will achieve their desired purpose.

Any method known to one of ordinary skill in the art may be used to prepare polyurethanes of the present invention, including one-shot method and prepolymer method. Methods suitable for forming the cover layers of the present invention include reaction injection molding ("RIM"), liquid injection molding ("LIM"), and pre-reacting the components to form an injection moldable thermoplastic polyurethane and then injection molding, all of which are known to one of ordinary skill in the art. Castable, reactive liquids that react to form a urethane elastomer material can be applied over the core to form desirable very thin outer cover layers using a variety of application techniques such as spraying, dipping, spin coating, or flow coating methods.

When golf balls are prepared according to the invention, they typically will have dimple coverage greater than about 60 percent, preferably greater than about 65 percent, and more preferably greater than about 75 percent. The resultant golf balls typically have a coefficient of restitution of greater than about 0.7, preferably greater than about 0.75, and more preferably greater than about 0.78. The golf balls also typically have an Atti compression of at least about 40, preferably from about 50 to about 120, and more preferably from about 60 to about 105. The flexural modulus of the cover on the golf balls, as measured by ASTM method D6272-98, Procedure B, is typically greater than about 500 psi, and is preferably from about 1,000 psi to about 50,000 psi, more preferably from about 5,000 psi to about 15,000 psi. As discussed herein, the outer cover layer is preferably formed from a relatively soft polyurethane material. In particular, the material of the outer cover layer should have a material hardness, as measured by ASTM-D2240, preferably less than about 60 Shore D, more preferably less than about 50 Shore D, and most preferably between about 30 and about 50 Shore D. The inner cover layer preferably has a material hardness of less than about 70 Shore D, more preferably between about 30 and about 70 Shore D, and most preferably between about 50 and about 65 Shore D.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

A golf ball in accordance to the present invention comprises a solid or multiple-layer solid core that includes a center and at least one intermediate layer. The core preferably has an Atti compression of less than about 80, more preferably, between about 20 and about 80, and most preferably, between about 50 and about 70. In an alternative, low compression embodiment, the core has an Atti compression of less than about 30, more preferably less than about 10, and most preferably, about 0. Preferably the entire core has an outer diameter of at least about 0.75 inches, more preferably between about 1.00 inch and about 1.65 inches, and most preferably between about 1.40 inches and about 1.60 inches. The intermediate layer, when present, preferably has a thickness of about 0.01 inches to about 0.40 inches, more preferably of about 0.05 inches to about 0.35 inches, and most preferably of about 0.10 inches to about 0.30 inches. The intermediate layer may of course include one or more layers therein such as inner core layers and outer core layers. Properties that are desirable for the cover include good moldability, high abrasion resistance, high tear strength, high resilience, and good mold release. The cover typically has a thickness to provide sufficient strength, good performance characteristics, and durability. The cover thickness ranges from about 0.01 inches to about 0.10 inches.

The present invention is further illustrated by the following non-limiting examples.

EXAMPLES

Examples 1–4

Table I below shows changes in cure characteristics of a first golf ball core composition as the content of the stable free radical (Tempo®) increases. This base formulation comprised 100 phr Bayer CB-23® as the polybutadiene base rubber, 0.80 phr DCP-70 (dicumyl peroxide at 70% activity) as the free radical initiator, 30 phr ZDA (zinc diacrylate) as the crosslinking agent, and 5.0 phr ZnO (zinc oxide) as the density filler. The examples were crosslinked by compression molding at 150° C. for 30 minutes. Cure characteristics were determined using a Monsanto rheometer MDR 2000E (range 2.5–3 Nm/arc 0.5.degree., ISO 6502-91).

TABLE I

| Sample # | Tempo ® phr | TS2 (sec) | TC90 (min.sec) | S'max (lb-in) |
|---|---|---|---|---|
| 1 | 0.00 | 24 | 9.27 | 103.02 |
| 2 | 0.05 | 49 | 8.56 | 89.80 |
| 3 | 0.10 | 74 | 9.20 | 80.41 |
| 4 | 0.20 | 135 | 11.41 | 62.26 |

According to the data shown in Table I, the scorch time (TS2) of the first polybutadiene rubber was significantly extended by about 100% with 0.05 phr Tempo®, by about 200% with 0.10 Tempo®, and by as much as about 560% with 0.20 phr Tempo ®. Concomitantly, the maximum torque (S'max) of the first polybutadiene rubber was reduced by about 13%, about 22%, and about 40%, respectively.

Examples 5–8

Table II below shows changes in cure characteristics of a second golf ball core composition as the content of the stable free radical (Tempo®) increases. This second base formulation comprised 100 phr Bayer CB-23®), 0.80 phr DCP-70, 35 phr ZDA, 5.0 phr ZnO, and 1.00 phr Zn PCTP (zinc pentaclorothiophenol) as the cis-to-trans catalyst.

TABLE II

| Sample # | Tempo ® phr | TS2 (sec) | TC90 (min.sec) | S'max (lb-in) |
|---|---|---|---|---|
| 5 | 0.00 | 32 | 11.24 | 105.40 |
| 6 | 0.05 | 43 | 11.53 | 96.66 |

TABLE II-continued

| Sample # | Tempo ® phr | TS2 (sec) | TC90 (min.sec) | S'max (lb-in) |
|---|---|---|---|---|
| 7 | 0.10 | 47 | 11.50 | 90.26 |
| 8 | 0.20 | 52 | 11.52 | 81.74 |

According to the data shown in Table II, the scorch time (TS2) of the second polybutadiene rubber was significantly extended by about 34% with 0.05 phr Tempo®, by about 47% with 0.10 Tempo®, and by about 160% with 0.20 phr Tempo®. Concomitantly, the maximum torque (S'max) of the second polybutadiene rubber was reduced by about 8%, about 14%, and about 22%, respectively.

Examples 9–16

Table III below shows changes in cure characteristics and physical properties of polybutadiene-based golf ball cores as a result of weight percentage variations in several components within the formulations, including the free radical initiator DCP-70, the crosslinking agent ZDA, the cis-to-trans catalyst ZnPCTP, and the stable free radical Tempo®. Identical in all eight samples are 100 phr Bayer CB-23® and 5.0 ZnO. Specific physical properties tested include flexural modulus, Atti compression, and coefficient of restitution ("COR") as a measure of resiliency.

TABLE III

| Weight (phr) | Ex. 9 | Ex. 10 | Ex. 11 | Ex. 12 | Ex. 13 | Ex. 14 | Ex. 15 | Ex. 16 |
|---|---|---|---|---|---|---|---|---|
| ZDA | 30 | 30 | 30 | 30 | 35 | 35 | 35 | 35 |
| DCP-70 | 0.80 | 0.80 | 1.10 | 1.10 | 0.80 | 0.80 | 1.10 | 1.10 |
| ZnPCTP | 0.00 | 1.00 | 1.00 | 0.00 | 0.00 | 1.00 | 1.00 | 0.00 |
| Tempo ® | 0.00 | 0.00 | 0.10 | 0.10 | 0.00 | 0.00 | 0.10 | 0.10 |
| Properties | | | | | | | | |
| Modulus (psi) | 9800 | 7400 | 8600 | 7400 | 12600 | 9900 | 10500 | 9200 |
| Compression | 85 | 65 | 76 | 65 | 103 | 85 | 90 | 80 |
| COR @ 125 fps | 0.795 | 0.809 | 0.807 | 0.786 | 0.805 | 0.817 | 0.814 | 0.794 |

As shown from the data in Table III, compounding effects of the components having different weight percentages on physical properties of the cores formed therefrom vary significantly from one combination to another. Therefore one of ordinary skill in the art may alter one or more of these components to construct golf ball cores having different sets of desirable physical properties and performance characteristics, with almost infinite possibilities.

All patents and patent applications cited in the foregoing text are expressly incorporated herein by reference in their entirety.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball comprising a core and a cover, wherein the core comprises an elastomeric polymer, a free radical initiator, a salt of unsaturated carboxylic acid having about 3 to about 8 carbon atoms, and at least one stable free radical comprising hydrazyl radicals, allyloxyl radicals, trityl radicals, galvinoxyl radicals, or derivatives thereof having at least one substituent group comprising amino, isocyanate, hydroxyl, carboxyl, oxirane, or thiirane.

2. The golf ball of claim 1, wherein the stable free radical is present in an amount sufficient to increase a scorch time of the elastomeric polymer during curing by at least about 10%.

3. The golf ball of claim 2, wherein the stable free radical is present in an amount sufficient to increase the scorch time by at least about 25%.

4. The golf ball of claim 1, wherein the stable free radical is present in an amount to increase the scorch time sufficient to substantially prevent backrinding.

5. The golf ball of claim 1, wherein the stable free radical is present in an amount sufficient to decrease a maximum torque of the elastomeric polymer during curing by at least about 5%.

6. The golf ball of claim 5, wherein the stable free radical is present in an amount sufficient to decrease the maximum torque by at least about 10%.

7. The golf ball of claim 1, wherein the core further comprises one or more nitroxide radicals or derivatives thereof having at least one substituent group comprising amino, isocyanate, hydroxyl, carboxyl, oxirane, or thiirane.

8. The golf ball of claim 7, wherein the nitroxide radicals or derivatives thereof comprise one or more compounds selected from the group consisting of 2,2,6,6-tetramethylpiperidinyloxy and derivatives thereof; 2,2,5,5-tetramethyl-1-pyrrolidinyloxy and derivatives thereof; 4,4-dimethyl-3-oxazolinyloxy and derivatives thereof; and di-t-butyl nitroxide and derivatives thereof.

9. The golf ball of claim 1, wherein the at least one stable free radical comprises 2,6-di-t-butyl-α-(3,5-di-t-butyl-4-oxo-2,5-cyclohexadien-1-ylidene)-p-tolyloxy or a derivative thereof.

10. The golf ball of claim 1, wherein the stable free radical is present in an amount between about 0.01 phr and about 20 phr by weight of the elastomeric polymer.

11. The golf ball of claim 10, wherein the amount of the stable free radical is between about 0.05 phr and about 5 phr by weight of the elastomeric polymer.

12. The golf ball of claim 7, wherein the one or more nitroxide radicals or derivatives thereof are present in an amount between about 0.01 phr and about 5 phr by weight of the elastomeric polymer.

13. The golf ball of claim 1, wherein the elastomeric polymer comprises one or more natural or synthetic elastomers selected from the group consisting of natural rubbers; balata; gutta-percha; synthetic polyisoprenes; styrene-butadiene rubbers; styrene-propylene-diene rubbers; chloroprene rubbers; acrylonitrile rubbers; acrylonitrile-butadiene rubbers; ethylene-propylene-diene terpolymers; polypropylene resins; ionomer resins; polyamides; polyesters; urethanes; polyureas; thermosetting or thermoplastic elastomers; metallocene catalyzed rubbers; styrene-ethylene block copolymers; maleic anhydride or succinate modified metallocene catalyzed ethylene copolymers; chlorinated polyethylenes; polysulfide rubbers; and fluorocarbons.

14. The golf ball of claim 13, wherein the elastomeric polymer comprises at least about 40 phr by weight of a polybutadiene having a cis-1,4 content of at least about 40%, a Mooney viscosity of at least about 20, a number molecular weight of at least about 150,000, and a polydispersity of less than about 4.0.

15. The golf ball of claim 1, wherein the free radical initiator comprises one or more peroxides.

16. The golf ball of claim 1, wherein the core is exposed to one or more high-energy radiation sources selected from the group consisting of electron beams; ultra-violet radiation; gamma radiation; X-ray radiation; infrared radiation; and heat.

17. The golf ball of claim 15, wherein the peroxides comprises one or more compounds selected from the group consisting of dicumyl peroxide; n-butyl-4,4di-(t-butylperoxy)-valerate; 1,1-bis(t-butylperoxy)-3,3,5-trimethylcyclohexane; α,α'-bis(t-butylperoxy)-dissopropylbenzene; 2,5-dimethyl-2,5-di(t-butylperoxy) hexane; di-t-butyl peroxide; di-t-amyl peroxide; di(2-t-butyl-peroxyisopropyl)benzene peroxide; lauryl peroxide; benzoyl peroxide, and t-butyl hydroperoxide.

18. The golf ball of claim 17, wherein the peroxide is dicumyl peroxide having an activity between about 70% and about 100%, and is present in an amount between about 0.05 phr and about 15 phr by weight of the elastomeric polymer.

19. The golf ball of claim 1, wherein the core further comprises one or more compounds selected from the group consisting of mercaptobenzothiazole; sulfenamide; dithiocarbamate; thiuram sulfide; guanidine; thiourea; xanthate; dithiophosphate; aldehyde-amine; dibenzothiadyl disulfide; N,N'-diccyclohexyl-2-benzothia-dylsulfenamide; hexamethylenetetramine; tetramethylthiuram disulfide; tetraethylthiuram disulfide; tetrabutylthiuram disulfide; N-oxydiethylene-2-benzothiazole sulfenamide; N,N-di-orthotolyguanidine; bismuth dimethyldithiocarbamate; N-cyclohexyl-2-benzothiazole sulfonamide; and N,N-diphenylguanidine.

20. The golf ball of claim 1, wherein the core further comprises one or more free radical scavangers and scorch retarders to increase a scorch time of the elastomeric polymer.

21. The golf ball claim of 20, wherein the free radical scavangers comprise one or more compounds selected from the group consisting of benzoquinones; hydroquinones; phenols; benzaldehydes; and cyclohexadiene-1-ones.

22. The golf ball of claim 20, wherein the scorch retarders comprise one or more compounds selected from the group consisting of cyclohexylthiophthalimide; phthalic anhydride; pyromellitic anhydride; benzene hexacarboxylic trianhydride; 4-methylphthalic anhydride; trimellitic anhydride; 4-chlorophthalic anhydride; salicylic acid; benzoic acid; maleic anhydride; citraconic anhydride; itaconic anhydride; N-nitrosodiphenyl-amine; [1,3,5-tris(4-tert-butyl-3-hydroxy-2,6-dimethylbenzyl)-1,3,5-triazine-2,4,6-(1H,3H,5H)-trione]; mono-phenyl and bis-phenyl derivatives of allyl compounds; hydroquinones with optional sulfur accelerators; acid salts of aminoalkyl phenols; triazoles; thiomorpholines; and monomeric monofunctional vinyl compounds.

23. The golf ball of claim 1, wherein the core further comprises one or more compounds selected from the group consisting of unsaturated vinyl compounds; polyfunctional monomers; phenylene bismaleimide; and sulfur.

24. The golf ball of claim 23, wherein the crosslinking agent comprises zinc diacrylate having an activity between about 70% and about 100%, and being present in an amount of less than about 40 phr by weight of the elastomeric polymer.

25. The golf ball of claim 1, wherein the core further comprises one or more compounds selected from the group consisting of cis-to-trans catalysts; fillers; foaming agents; antioxidants; processing aids, processing oils; plasticizers: dyes; and pigments.

26. The golf ball of claim 1, wherein the core comprises a center and at least one outer core layer, and wherein the stable free radical is present in the center, the outer core layer, or both.

27. The golf ball of claim 1, wherein the core is solid or fluid-filled.

28. A golf ball comprising a core and a cover, wherein the cover is formed of a composition comprising a salt of a stable free radical and at least one thermoplastic or thermosetting material.

29. The golf ball of claim 28, wherein the salt of the stable free radical comprises a cationic N-oxoammonium salt of one or more compounds selected from the group consisting of 2,2,6,6-tetramethlpiperidinyloxy and derivatives thereof; 2,2,5,5-tetramethyl-1-pyrrolidinyloxy and derivatives thereof; 4,4-dimethyl-3-oxazolinyloxy and derivatives thereof; and di-t-butyl nitroxide and derivatives thereof.

30. The golf ball of claim 28, wherein the thermoplastic or thermosetting material comprises one or more homopolymers or copolymers selected from the group consisting of ionomeric copolymers or terpolymers of ethylene and unsaturated monocarboxylic acids; vinyl resins; polyolefins; polyurethanes; polyureas; polyamides; acrylic resins and blends thereof; block copolymers; copoly(ether-amide); polyphenylene oxide resins and blends thereof; thermoplastic polyesters; and blends and alloys.

31. The golf ball of claim 28, wherein the cover composition further comprises one or more compounds selected from the group consisting of antioxidants; catalysts; colorants including pigments and dyes; hindered amine light stabilizers; optical brighteners; UV absorbers; fillers; plasticizers; surfactants; viscosity modifiers; compatibility agents; dispersing agents; foaming agents; reinforcement agents; and release agents.

32. The golf ball of claim 28, wherein the cover comprises at least one inner cover layer and an outer cover layer, and wherein the stable free radical or derivative thereof is present in at least one of the inner and outer cover layers.

* * * * *